US005381733A

United States Patent [19]

Hirashima

[11] Patent Number: 5,381,733

[45] Date of Patent: Jan. 17, 1995

[54] GRAVURE PRINTER WITH DOCTOR BLADE GRINDING ABRASIVE EDGED SHEET

[75] Inventor: Shigeyoshi Hirashima, Kanagawa, Japan

[73] Assignee: Sony Corporation, Japan

[21] Appl. No.: 125,687

[22] Filed: Sep. 24, 1993

[30] Foreign Application Priority Data

Sep. 28, 1992 [JP] Japan ..... 4-257677

[51] Int. Cl.[6] ..... B41F 9/10

[52] U.S. Cl. ..... 101/157; 101/375; 15/256.5

[58] Field of Search ..... 101/157, 169, 170; 15/256.5, 256.51

[56] References Cited

U.S. PATENT DOCUMENTS 3,641,932 2/1972 Behringer ..... 101/157
3,749,014 7/1973 Gates ..... 101/157
4,139,613 2/1979 Hefele ..... 101/157
4,912,824 4/1990 Baran ..... 101/170
5,134,936 8/1992 John ..... 101/157
5,247,884 9/1993 Rid ..... 101/375

*Primary Examiner*—Eugene H. Eickholt
*Attorney, Agent, or Firm*—Ronald P. Kananen

[57] ABSTRACT

A Gravure printer comprises a mounting cylinder, an engraved printing sheet wound on the mounting cylinder, an ink supplier for supplying a surface of the printing sheet with ink, a doctor blade having a leading edge which scrapes the surface of the printing sheet to remove excess ink, and an impression cylinder for pressing a cut paper against the surface of the printing sheet. The feature of the invention is that the printing sheet is provided with an abrasive part to which the leading edge of the doctor contacts to be ground during rotation of the mounting cylinder.

17 Claims, 4 Drawing Sheets

GRAVURE PRINTER WITH DOCTOR BLADE GRINDING ABRASIVE EDGED SHEET

BACKGROUND OF THE INVENTION

1. Field of the Invention

The present invention relates in general to printers, and more particularly to Gravure printers. More specifically, the present invention is concerned with a Gravure printing device which generally comprises a mounting cylinder around which an engraved printing sheet is wound, an ink supplier which feeds a surface of the engraved printing sheet with ink, a doctor blade which scrapes the surface of the printing sheet to remove excess ink therefrom, and an impression cylinder which presses a piece of paper against the surface of the printing sheet.

2. Description of the Prior Art

As is known, Gravure printing is widely used in the field of printing for the print of good quality. Gravure printing is accomplished by engraving and etching various sizes of minute cells (or wells) below the surface of a printing sheet to hold the ink. The engraved printing sheet is wound around a mounting cylinder. After the cells are flooded and loaded with ink, the surface of the engraved printing sheet is scraped of excess ink by a doctor blade. Thus, the leading edge of the doctor blade is kept pressed against the surface of the engraved printing sheet under rotation of the mounting cylinder. The ink remaining in the cells is transferred to the surface of a piece of paper which is pressed against the engraved printing sheet by an impression cylinder.

Due to the nature of such printing process, during a printing operation, paper dust, air dust and the like tend to stick on the surface of the engraved printing sheet. Furthermore, during the printing operation, some of carbon particles contained in the engraved printing sheet become exposed from the surface. Usually, such foreign things are scraped off by the doctor blade together with the excess ink during operation of the printer.

However, due to presence of such foreign things, it sometimes happens that the leading edge of the doctor blade is nicked or chipped to such a severe degree as not to maintain a satisfied ink scraping function. Of course, in this case, the print of good quality is not expected. Usually, the doctor blade is constructed of a ceramic which is harder than the engraved printing sheet. Thus, once the doctor blade is nicked or chipped, the printing sheet is easily damaged.

SUMMARY OF THE INVENTION

It is therefore an object of the present invention to provide a printing apparatus which is free of the above-mentioned drawbacks.

According to a first aspect of the present invention, there is provided a printing apparatus which comprises a mounting cylinder on which an engraved printing sheet is wound; an impression cylinder for pressing a print material against a surface of the engraved printing sheet; ink supply means for supplying the surface of the engraved printing sheet with ink; and a doctor blade for scraping the surface of the engraved printing sheet to remove excess ink therefrom, wherein the engraved printing sheet is provided with an abrasive part to which a leading edge of the doctor blade contacts to be ground during rotation of the mounting cylinder.

According to a second aspect of the present invention, there is provided a printing sheet for use in a printing apparatus which has a mounting cylinder and a doctor blade. The printing sheet comprising a flexible base plate which is to be wound around the mounting cylinder; means for providing a surface of the flexible base plate with a desired engraved images; and an abrasive portion provided on the flexible base plate, the abrasive portion grinding a working edge of the doctor blade under rotation of the mounting cylinder.

According to a third aspect of the present invention, there is provided a Gravure printer which comprises a mounting cylinder which is rotatable about its axis; an engraved printing sheet disposed about the mounting cylinder to rotate therewith; an ink supplier for supplying a surface of the engraved printing sheet with ink; a doctor blade having a leading edge which scrapes the surface of the engraved printing sheet to remove excess ink; and an impression cylinder for pressing a cut paper against the surface of the engraved printing sheet, wherein the engraved printing sheet is provided with an abrasive part to which the leading edge of the doctor blade contacts to be abraded during rotation of the mounting cylinder.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
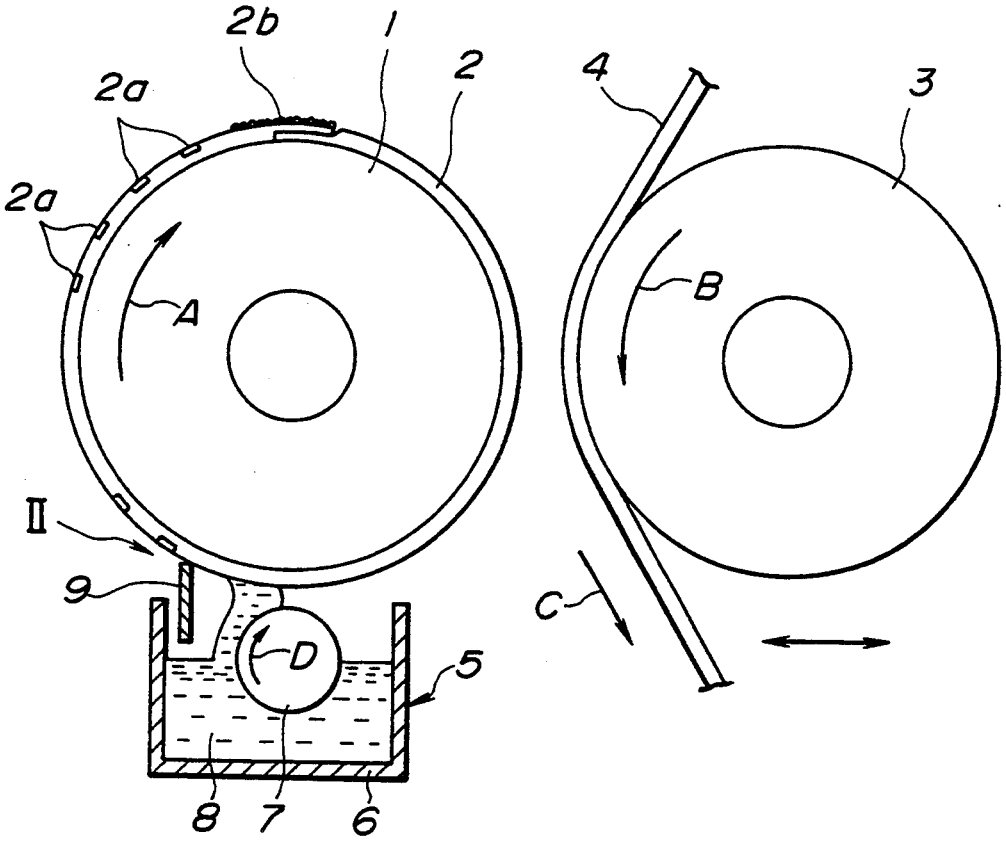
FIG. 1 is a schematic illustration of a Gravure printer according to the present invention.

Referring to FIGS. 1 to 5, particularly FIG. 1, there is shown a Gravure printer according to the present invention.

As shown in FIG. 1, the Gravure printer comprises a mounting cylinder 1 which is rotatably arranged. Although not shown in the drawing, a known drive mechanism is used to drive the mounting cylinder 1 in the direction of the arrow "A". An engraved printing sheet 2 is wound round the mounting cylinder 1 having opposed end portions overlapped. As is seen from FIG. 2, the opposed end portions of the printing sheet 2 are reduced in thickness, so that the rounded printing sheet 2 has a substantially even thickness throughout the length thereof.

An impression cylinder 3, which is rotatable, is positioned in the vicinity of the mounting cylinder 1. A known shift mechanism is employed for causing the impression cylinder 3 to move between a rest position wherein, as shown, the impression cylinder 3 is kept away from the mounting cylinder 1 and a work position wherein the impression cylinder 3 is pressed against the surface of the engraved printing sheet 2 with a cut paper 4 interposed therebetween. Thus, when the impression cylinder 3 assumes the work position, the same is forced to rotate in the direction of the arrow "B" by the mounting cylinder 1 conveying the cut paper 4 in the direction of the arrow "C ".

Below the mounting cylinder 1, there is arranged an ink supplier 5 which comprises an ink reservoir 6. An ink feeding roller 7 is installed in the ink reservoir 6 and driven in the direction of the arrow "D" by a drive mechanism (not shown) to feed the surface of the engraved printing sheet 2 with the ink. With this, the cells of the surface of the printing sheet 2 are flooded and loaded with the ink.

A doctor blade 9 constructed of a ceramic or the like is positioned behind the ink feeding roller 7 with respect to the rotation direction "A" of the mounting cylinder 1. Due to a biasing device (not shown) such as a spring or the like, the leading edge of the doctor blade 9 is pressed upon the surface of the printing sheet 2. As is seen from FIG. 1, the doctor blade 9 has a lower end located in the ink reservoir 6. Thus, the ink scraped by the doctor blade 9 can be returned to the ink reservoir 6.

Figure 3:
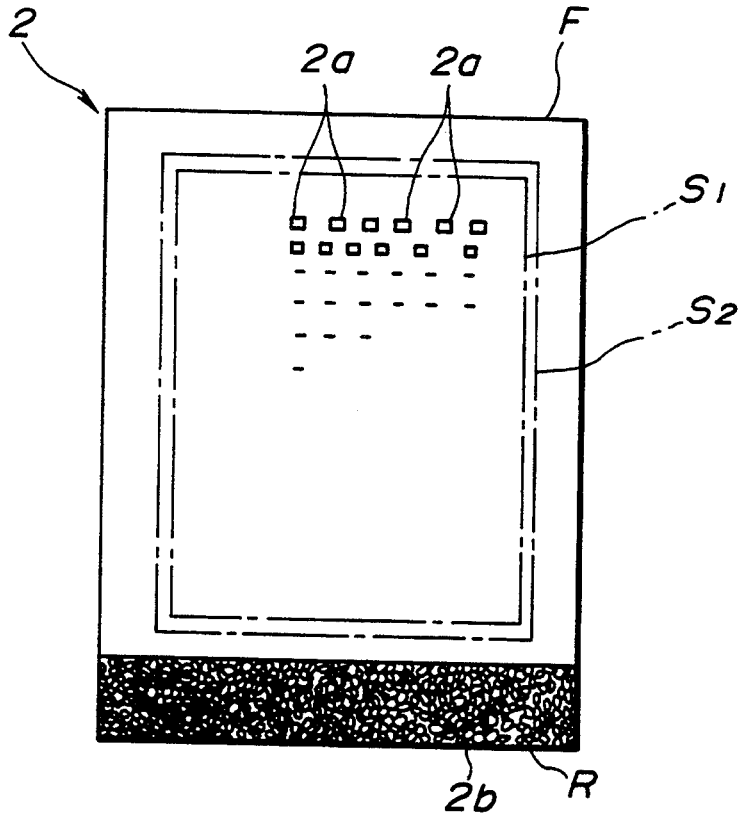
FIG. 3 is a front view of an engraved printing sheet used in the Gravure printer of the present invention.

The detail of the engraved printing sheet 2 will be understood from FIG. 3 which shows the sheet 2 in an unfolded condition.

The printing sheet 2 comprises a flexible base plate of polyethylene terephthalate (PET), one surface of which is lined with a polyethylene film impregnated with carbon particles.

In FIG. 3, designated by numerals 2*a* are the cells which are formed below the surface of the printing sheet 2 to hold the ink. Such cells 2*a* may be formed by using laser beams. As shown, the cells 2*a* are positioned within a rectangular zone which is designated by reference "S1". The rectangular zone "S1" is somewhat smaller than another rectangular zone "S2" which has the same size as the cut paper 4 (viz., rectangularly cut paper). That is, under a printing operation, each cut paper 4 is pressed against the larger rectangular zone "S2" by the impression cylinder 3 one after another.

As shown in FIG. 3, one end portion of the engraved printing sheet 2 constitutes an abrasive part 2*b* which is separated from the larger rectangular zone "S2". As will become apparent as the description proceeds, the abrasive part 2*b* constitutes an exposed end portion of the printing sheet 2 when wound round the mounting cylinder 1. The abrasive part 2*b* is provided by applying abrasive material to the printing sheet 2.

The abrasive material may contain abrasive particles of alumina of about 0.1 μm to about 1 μm in diameter. Of course, the type of the abrasive particles and the mixing ratio of the same should be determined in view of the material of the doctor blade 9. Furthermore, if desired, a separate abrasive paper of about 10000 mesh may be bonded to the rear end portion of the printing sheet 2.

In order to properly wind the engraved printing sheet 2 round the mounting cylinder 1, the following steps are employed. Of course, the longitudinal length of the printing sheet 2 is somewhat longer that the circumference of the mounting cylinder 1 and the longitudinally opposed end portions of the printing sheet 2 are reduced in thickness.

First, a front end "F" (see FIG. 3) of the engraved printing sheet 2 is fixed to a certain portion of the cylindrical wall of the mounting cylinder 1. Then, the mounting cylinder 1 is slowly rotated in a reversed direction (viz., a direction opposite to the direction "A") gradually winding therearound the remaining of the flexible printing sheet 2. When the mounting cylinder 1 makes one turn, the turning is stopped. Under this condition, a rear end portion "R" (see FIG. 3) of the printing sheet 2 is put on the fixed front end "F", as is understood from FIG. 2. Then, the rear end portion "R" is secured to the front end "F" by means of a bonding agent or the like. With this, the engraved printing sheet 2 is tightly put around the mounting cylinder 1 having the abrasive part 2*b* thereof put on the front end "F" and thus exposed to the outside.

In the following, operation of the Gravure printer of the invention will be described with reference to FIGS. 1 and 2.

When the printer is switched ON, the mounting cylinder 1 and the ink feeding roller 7 begin to rotate in the directions indicated by the arrows "A" and "D". Thus, due to the work of the ink feeding roller 7, a given amount of ink in the ink reservoir 6 is applied to the surface of the engraved printing sheet 2 on the mounting cylinder 1, as shown in FIG. 1. With this, the cells 2*a* in the surface of the printing sheet 2 are flooded with the ink. Then, the surface of the printing sheet 2 is scraped by the leading edge of the doctor blade 9 to remove excess ink on the surface. Then, the impression cylinder 3 is moved to the work position to press the rectangular cut paper 4 against the printing sheet 2, more particularly, against the larger rectangular zone "S2" of the printing sheet 2. With this, the ink remained in the cells 2*a* is transferred to the surface of the paper 4 to establish printing on the paper 4.

Figure 2:
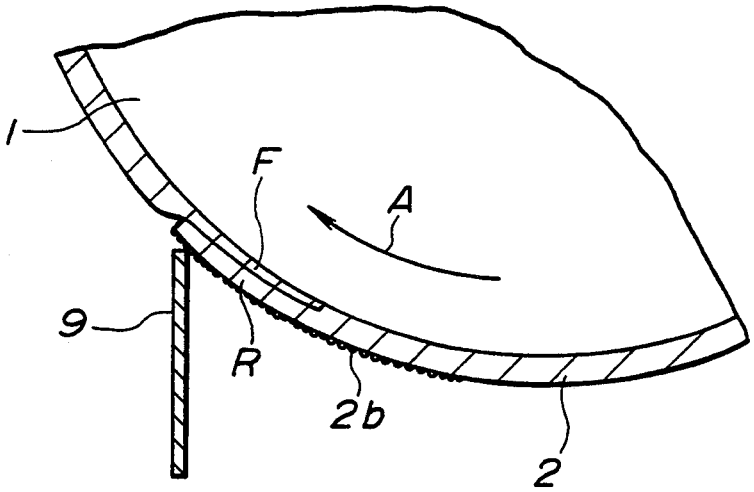
FIG. 2 is an enlarged view of the portion indicated by the arrow "II" in FIG. 1, showing a condition wherein a leading edge of a doctor blade is being ground.

As is best understood from FIG. 2, during the printing operation, the leading edge of the doctor blade 9 is ground or polished each time the mounting cylinder 1 rotates, Thus, even when the leading edge of the doctor blade 9 is nicked or chipped due to the above-mentioned reasons, the broken edge of the doctor blade 9 is thereafter gradually ground and reformed by the abrasive part 2*b* of the printing sheet 2. Thus, the normal work of the doctor blade 9 can be kept for a long time.

Figure 4:
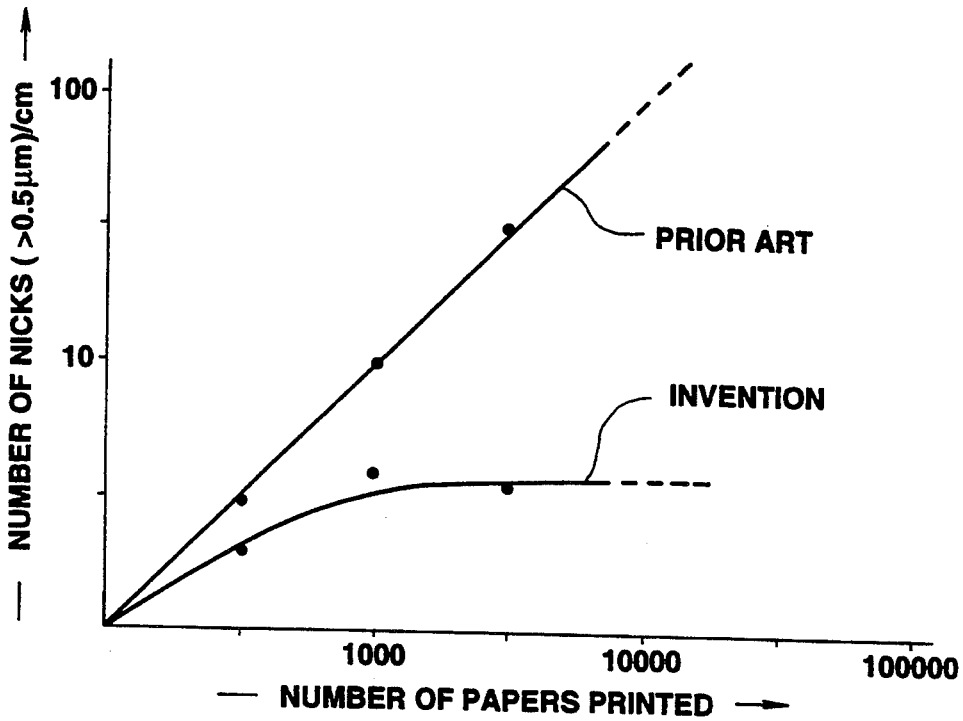
FIG. 4 is a graph showing the characteristic of the present invention and that of a conventional Gravure printer, in terms of the relationship between the number of papers printed by the printer and the number of nicks appearing in the leading edge of the doctor blade.

FIG. 4 is a graph depicting one advantageous matter given by the present invention.

As is seen from this graph, according to the present invention, the number of nicks appearing in the leading edge of the doctor blade 9 is saturated to about 3 per centimeter at the time when the papers 4 are printed by the amount of about one thousand. While, in the prior art printer, the number of nicks in the doctor blade increases infinitely with increase of the number of papers printed.

Figure 5:
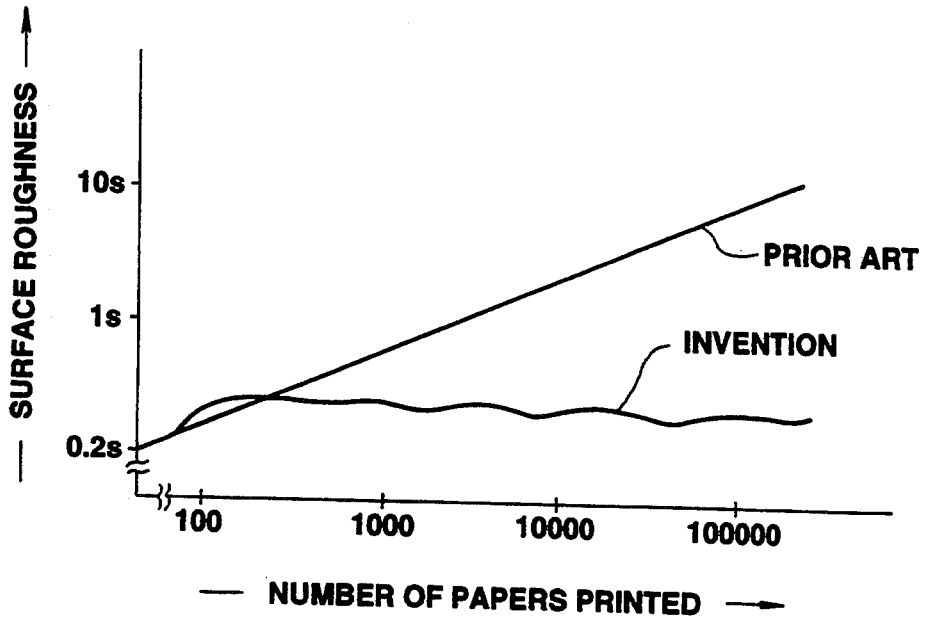
FIG. 5 is a graph showing the characteristic of the present invention and that of the conventional Gravure printer, in terms of the relationship between the number of papers printed by the printer and the surface roughness of the leading edge of the doctor blade.

FIG. 5 is a graph depicting another advantageous matter given by the present invention. As is seen from this graph, according to the present invention, the surface roughness of the leading edge of the doctor blade 9 is kept at about 0.3s irrespective of the number of papers 4 printed. This means that the leading edge of the doctor blade 9 has a certain resistance against the nicking and chipping.

Due to provision of the abrasive park 2*b*, the foreign things caught by the doctor blade 9 are smashed to tiny pieces during operation of the printer, which minimizes or at least reduces the possibility of nicking or chipping the leading edge of the doctor blade 9.

Figure 6:
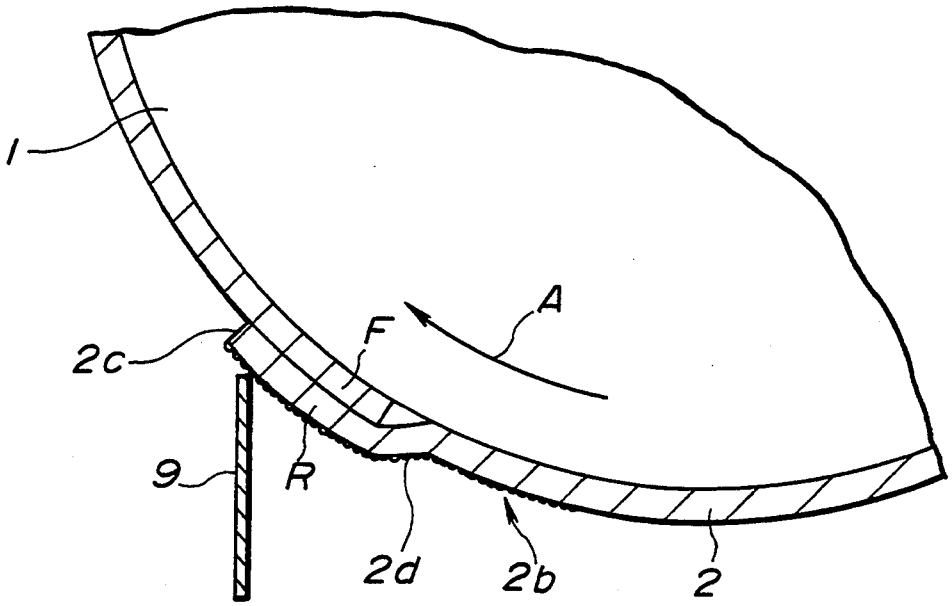
FIG. 6 is a view similar to FIG. 2, but showing a modification of the present invention.

Referring to FIG. 6, there is shown a modification of the present invention.

As shown in the drawing, in this modification, the longitudinal end portions "F" and "R" of the printing sheet 2 are not reduced in thickness, unlike the case of the above-mentioned printing sheet 2 of FIG. 2. That is, as is seen from FIG. 6, the rear end portion "R" of the printing sheet 2 is put on the front end portion "F" of the same to provide the rounded printing sheet 2 with a radially outwardly projected portion whose outer surface is applied with the abrasive material. Thus, the projected part constitutes the abrasive part 2*b*.

Upon each rotation of the mounting cylinder 1 in the direction of the arrow "A", the doctor blade 9 abuts against a front end 2*c* of the projected portion, and rides on the projected portion, and then slides down along a smoothly inclined portion 2*d* of the projected portion. Tests have revealed that the abutment of the doctor blade 9 against the front end 2*c* of the projected portion does not induce spattering of the ink scraped by the doctor blade 9 over the printing sheet 2.

Figure 7:
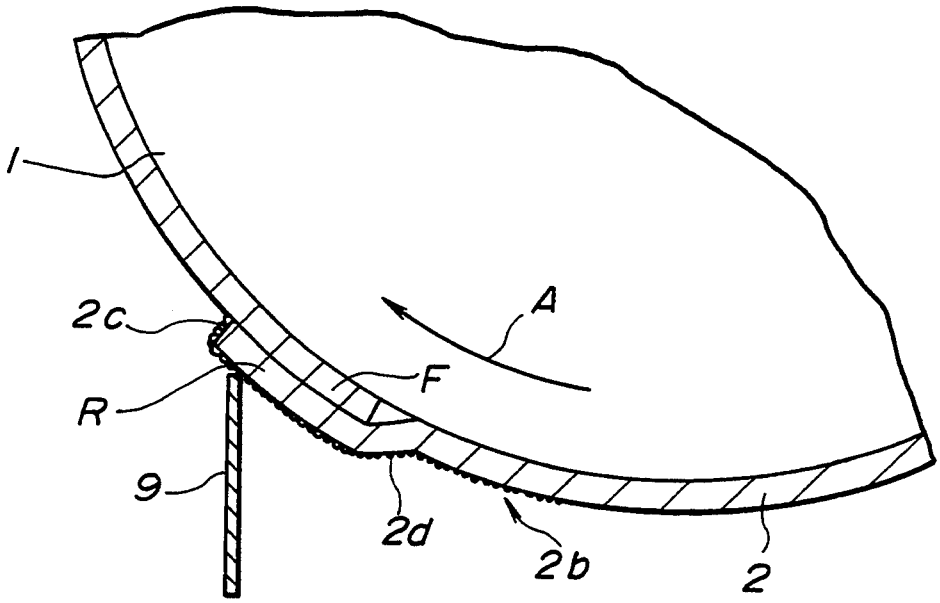
FIG. 7 is a view similar to FIG. 2, but showing another modification of the present invention.

Referring to FIG. 7, there is shown another modification of the present invention.

This modification is substantially the same as the above-mentioned modification of FIG. 6 except the following.

That is, as is shown in the drawing, also the front end 2*c* of the raised end portion "R" of the printing sheet 2 is applied with the abrasive material. Because the front end 2*c* is also applied with the abrasive material, the doctor blade 9 is ground concavely at its upper front surface, which induces a smoothed contact of the leading edge of the doctor blade 9 with the surface of the engraved printing sheet 2.

What is claimed is:

1. A printing apparatus comprising:

a mounting cylinder on which an engraved printing sheet is wound;

an impression cylinder for pressing a print material against a surface of said engraved printing sheet;

ink supply means for supplying the surface of said engraved printing sheet with ink; and a doctor blade for scraping the surface of said engraved printing sheet to remove excess ink therefrom, wherein said engraved printing sheet is provided with an abrasive part to which a leading edge of said doctor blade contacts to be ground during rotation of said mounting cylinder.

2. A printing apparatus as claimed in claim 1, in which the engraved surface of said printing sheet is processed by using laser beams.

3. A printing apparatus as claimed in claim 2, in which said abrasive part has an enough area so as to grind a whole working edge of said doctor blade.

4. A printing apparatus as claimed in claim 3, in which said abrasive part is formed on one longitudinal end portion of said printing sheet, and in which the other longitudinal end portion of said printing sheet is positioned under said one longitudinal end portion when said printing sheet is properly wound around said mounting cylinder.

5. A printing apparatus as claimed in claim 1, in which said abrasive part is provided by applying abrasive material to the end portion of said printing sheet.

6. A printing apparatus as claimed in claim 1, in which said abrasive part comprises a separate abrasive paper which is bonded to said printing sheet.

7. A printing apparatus as claimed in claim 1, in which said abrasive part is formed on one longitudinal end portion of said printing sheet, said one longitudinal end portion being put on the other longitudinal end portion of said printing sheet and directed in the same direction as a direction in which said mounting cylinder rotates under normal operation of the printing apparatus.

8. A printing sheet for use in a printing apparatus which has a mounting cylinder and a doctor blade, said printing sheet comprising:

a flexible base plate which is to be wound round said mounting cylinder;

means for providing a surface of said flexible base plate with a desired engraved images; and an abrasive portion provided on said flexible base plate, said abrasive portion grinding a working edge of said doctor blade under rotation of said mounting cylinder.

9. A printing sheet as claimed in claim 8, in which said abrasive portion is provided by applying abrasive material to said flexible base plate.

10. A printing sheet as claimed in claim 8, in which said abrasive part comprises a separate abrasive paper which is bonded to said flexible base plate.

11. A Gravure printer comprising:

a mounting cylinder which is rotatable about its axis;

an engraved printing sheet wound around said mounting cylinder to rotate therewith;

an ink supplier for supplying a surface of said engraved printing sheet with ink;

a doctor blade having a leading edge which scrapes the surface of said engraved printing sheet to remove excess ink therefrom; and an impression cylinder for pressing a cut paper against said surface of the engraved printing sheet, wherein said engraved printing sheet is provided with an abrasive part to which said leading edge of the doctor blade contacts to be ground during rotation of said mounting cylinder.

12. A Gravure printer as claimed in claim 11, in which said abrasive part is apart from a given part of said engraved printing sheet against which given part said cut paper is wholly pressed by said impression cylinder.

13. A Gravure printer as claimed in claim 12, in which said abrasive part is constructed by applying abrasive particles to said engraved printing sheet.

14. A Gravure printer as claimed in claim 12, in which said abrasive part is formed on an outer surface of one end portion of said engraved printing sheet, said one end portion being put on the other end portion of said engraved printing sheet.

15. A Gravure printer as claimed in claim 14, in which each of the opposed end portions of said engraved printing sheet is reduced in thickness, so that the rounded engraved printing sheet on the mounting cylinder has substantially even thickness throughout the length thereof.

16. A Gravure printer as claimed in claim 14, in which the opposed end portions of said engraved printing sheet are put on each other to constitute a projected portion on the surface of said printing sheet, said projected portion carrying said abrasive part.

17. A Gravure printer as claimed in claim 16, in which said projected portion is formed at its leading portion with a stepped edge which is coated with the abrasive material.

* * * * *